US006360998B1

(12) United States Patent
Halvorson et al.

(10) Patent No.: US 6,360,998 B1
(45) Date of Patent: Mar. 26, 2002

(54) METHOD AND APPARATUS FOR CONTROLLING TRAINS BY DETERMINING A DIRECTION TAKEN BY A TRAIN THROUGH A RAILROAD SWITCH

(75) Inventors: David H. Halvorson, Cedar Rapids; Joe B. Hungate; Stephen R. Montgomery, both of Marion, all of IA (US)

(73) Assignee: Westinghouse Air Brake Company, Wilmerding, PA (US)

( * ) Notice: Subject to any disclaimer, the term of this patent is extended or adjusted under 35 U.S.C. 154(b) by 0 days.

(21) Appl. No.: 09/094,174

(22) Filed: Jun. 9, 1998

(51) Int. Cl.[7] ..... B61L 23/34
(52) U.S. Cl. ..... 246/122 R
(58) Field of Search ..... 246/122 R, 123, 246/124, 122 A

(56) References Cited

U.S. PATENT DOCUMENTS

| | | | | |
|---|---|---|---|---|
| 4,932,618 A | * | 6/1990 | Davenport et al. | 246/122 |
| 5,361,070 A | | 11/1994 | McEwan | 342/21 |
| 5,457,394 A | | 10/1995 | McEwan | 324/642 |
| 5,510,800 A | | 4/1996 | McEwan | 342/387 |
| 5,512,834 A | | 4/1996 | McEwan | 324/642 |
| 5,603,556 A | * | 2/1997 | Klink | 303/22.6 |
| 5,630,216 A | | 5/1997 | McEwan | 455/215 |

* cited by examiner

*Primary Examiner*—S. Joseph Morano
*Assistant Examiner*—Robert J. McCarry, Jr.
(74) *Attorney, Agent, or Firm*—James Ray & Associates

(57) ABSTRACT

An apparatus for determining the presence of a third rail disposed between parallel railroad tracks as a train progresses along said parallel railroad tracks and further for determining the relative direction of motion of said third rail with respect to said first two rails and further for determining the rate at which the third rail moves with respect to the first rails is disclosed, which is a low power radar sensor disposed underneath the rail vehicle and directed toward the rail on the opposing side of the vehicle. In a preferred embodiment, two rail detectors are shown which are disposed on opposite sides of the rail vehicle. The radar detectors are coupled with an onboard computing device and with other components of an advanced train control system which can be used for precisely locating the train on closely spaced parallel tracks and further for updating and augmenting position information used by the advanced train control system. The system including GPS receivers and wheel tachometers for providing alternate sources of information for position determination.

20 Claims, 4 Drawing Sheets

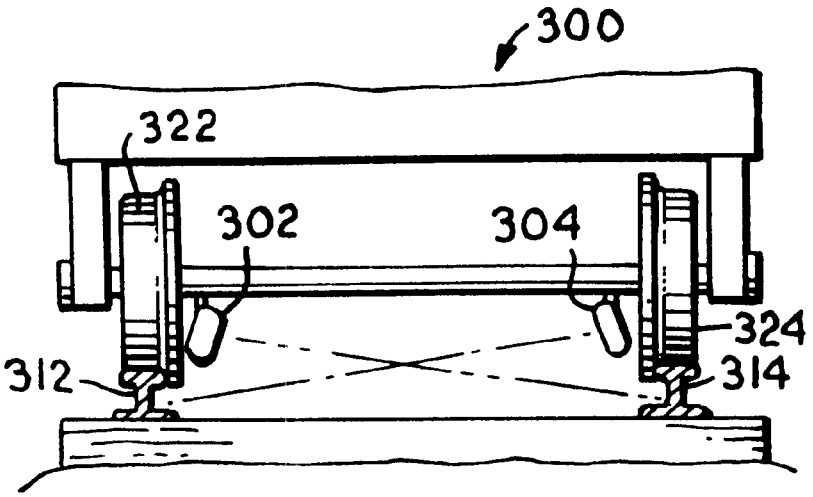
Fig.3.
Fig.5.
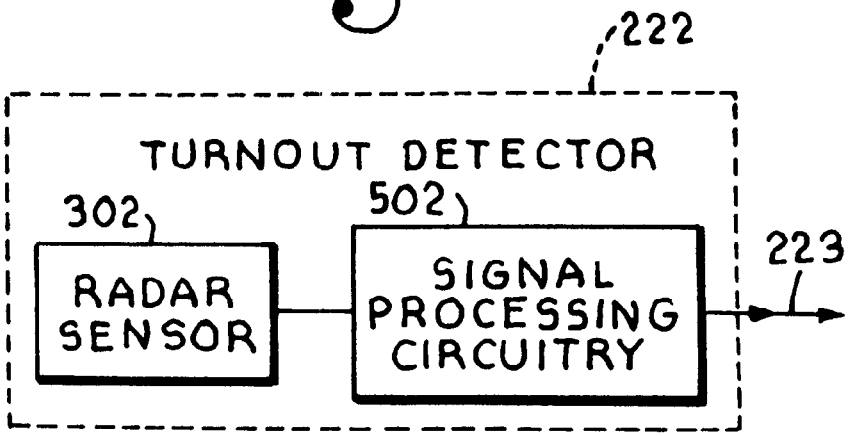

METHOD AND APPARATUS FOR CONTROLLING TRAINS BY DETERMINING A DIRECTION TAKEN BY A TRAIN THROUGH A RAILROAD SWITCH

CROSS-REFERENCE TO RELATED APPLICATIONS

The application of the present invention relates to and incorporates herein by these references co-pending applications: (1) U.S. Ser. No. 09/094,297 entitled "Apparatus and Method for Detecting Railroad Locomotive Turns by Monitoring Truck Orientation" by David H. Halvorson and Joseph B. Hungate, and (2) U.S. Ser. No. 09/094,173 entitled "Method and Apparatus for Using Machine Vision to Detect Relative Locomotive Position on Parallel Tracks" by Jeffrey D. Kernwein, both of which were filed on even date herewith, Jun. 9, 1998, and are subject to assignment to the same entity as the present application.

BACKGROUND OF THE INVENTION

The present invention generally relates to railroads, and more specifically relates to train controlsystems and even more particularly relates to automatic and remote sensing of rail switches.

In the past, train control systems have been used to facilitate the operation of trains. These train control systems have endeavored to increase the density of trains on a track system while simultaneously maintaining positive train separation. The problem of maintaining positive train separation becomes more difficult when parallel tracks are present. Often, parallel tracks exist with numerous cross-over switches for switching from one track to another. It is often very difficult for electronic and automatic systems such as train control systems to positively determine upon which of several parallel train tracks a train may be located at any particular time. For example, when tracks are parallel, they are typically placed very close to each other with a center-to-center distance of approximately fourteen (14) feet.

In the past, several different methods have been attempted to resolve the potential ambiguity of which track, of a group of parallel tracks, a train may be using. These methods have included use of global positioning system receivers, track circuits and inertial navigation sensors. These prior art approaches of determining which track is being used each have their own significant drawbacks. Firstly, standard GPS receivers are normally incapable of positively resolving the position of the train to the degree of accuracy required. The separation of approximately fourteen (14) feet between tracks is often too close for normal GPS receivers to provide a positive determination of track usage. The use of differential GPS increases the accuracy; i.e. reduces the uncertainty in the position determined. However, differential GPS would require that numerous remotely located differential GPS transmitter "stations" be positioned throughout the country. The United States is not currently equipped with a sufficient number of differential GPS transmitting stations to provide for the accuracy needed at all points along the U.S. rail systems.

The track circuits which have been used in the past to detect the presence of a train on a particular track also require significant infrastructure investment to provide comprehensive coverage. Currently, there are vast areas of "dark territory" in which the track circuits are not available. Additionally, these track circuits are subject to damage at remote locations and are susceptible to intentional sabotage.

The inertial navigation sensors proposed in the past have included both gyroscopes and acceleration sensors. The gyroscopes are capable of sensing a very gradual turn; however, gyros with sufficient accuracy to sense such turns are very expensive. Acceleration sensors, while they are less expensive than sensitive gyros, typically lack the ability to sense the necessary movement of a train especially when a switch designed for high speed is being made from one parallel track to another at very low speeds.

Consequently, there exists a need for improvement in advanced train controlsystems which overcome the above-stated problems.

SUMMARY OF THE INVENTION

It is an object of the present invention to provide a train control system having enhanced positive train separation capabilities.

It is a feature of the present invention to include a train control system having capabilities for sensing the direction a train takes through switches.

It is an advantage of the present invention to reduce the ambiguity of track occupancy which is often present when trains operate within a group of parallel tracks.

It is another object of the present invention to improve the position determination accuracy of trains.

It is another feature of the present invention to include a sensor on board the train for sensing intermediate tracks which exist between the wheels of a locomotive as it passes between a switchpoint and a "cross-over frog" or other cross-track rails.

It is an advantage of the present invention to provide additional information regarding train position which can be used to supplement and update other positional information, including GPS signals and for crosschecking a database.

It is yet another object of the present invention to provide information as to the type of switch a train is passing through.

It is yet another feature of the present invention to monitor the relative rate at which the intermediate track switches from predetermined positions on one side of a locomotive to a predetermined position at the other side of the locomotive.

It is an advantage of the present invention to allow train control systems to determine the angle of a switch as it is passed.

The present invention is a method and apparatus for controlling trains by detecting intermediate rails between the traveled rails, which is designed to satisfy the aforementioned needs, provide the previously stated objects, include the above-listed features, and achieve the already articulated advantages. The invention is carried out in an "ambiguity-less" system in the sense that track ambiguity is greatly reduced by providing information on the passage of switches, the angle of switches passed, and the direction taken by the train as it passes through the switch.

Accordingly, the present invention is a method and apparatus for determining the presence and orientation of an intermediate track disposed between the tracks over which a train is traveling.

BRIEF DESCRIPTION OF THE DRAWINGS

The invention may be more fully understood by reading the following description of the preferred embodiments of the invention, in conjunction with the appended drawings wherein:

FIG. 3 is an elevational view of a rail vehicle incorporating the sensors of the present invention showing the orientation of the sensors with respect to the rails over which the rail vehicle travels.

FIG. 5 is a diagram of the distance sensor of the present invention.

DESCRIPTION OF THE PREFERRED EMBODIMENT

Figure 1:
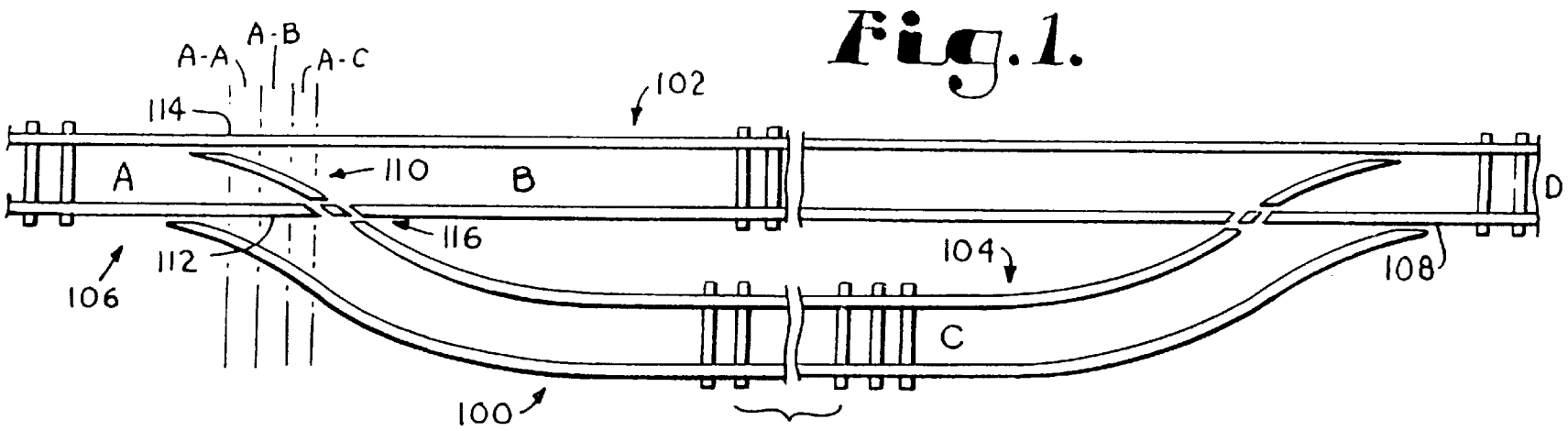
FIG. 1 is a plan view of a common parallel track configuration showing a turnout and two switches.

Now referring to the drawings, wherein like numerals refer to like matter throughout, and more particularly to FIG. 1, there is shown a section of rail tracks generally designated 100, having a first set of tracks 102 and a second set of tracks 104. Connecting tracks 102 and 104 are switches 106 and 108. Also shown for discussion purposes are several positions along the tracks. Position A represents a position on track 102. Position B represents a position along track 102 which is disposed between switch 106 and 108 while position C represents a position on track 104 disposed between switch 106 and 108 and position D represents a position along track 102.

Also shown in FIG. 1 are track segments 110 and 112, together with crossover frog 116. Also shown are positions AA, AB, and AC along tracks 102.

Figure 2:
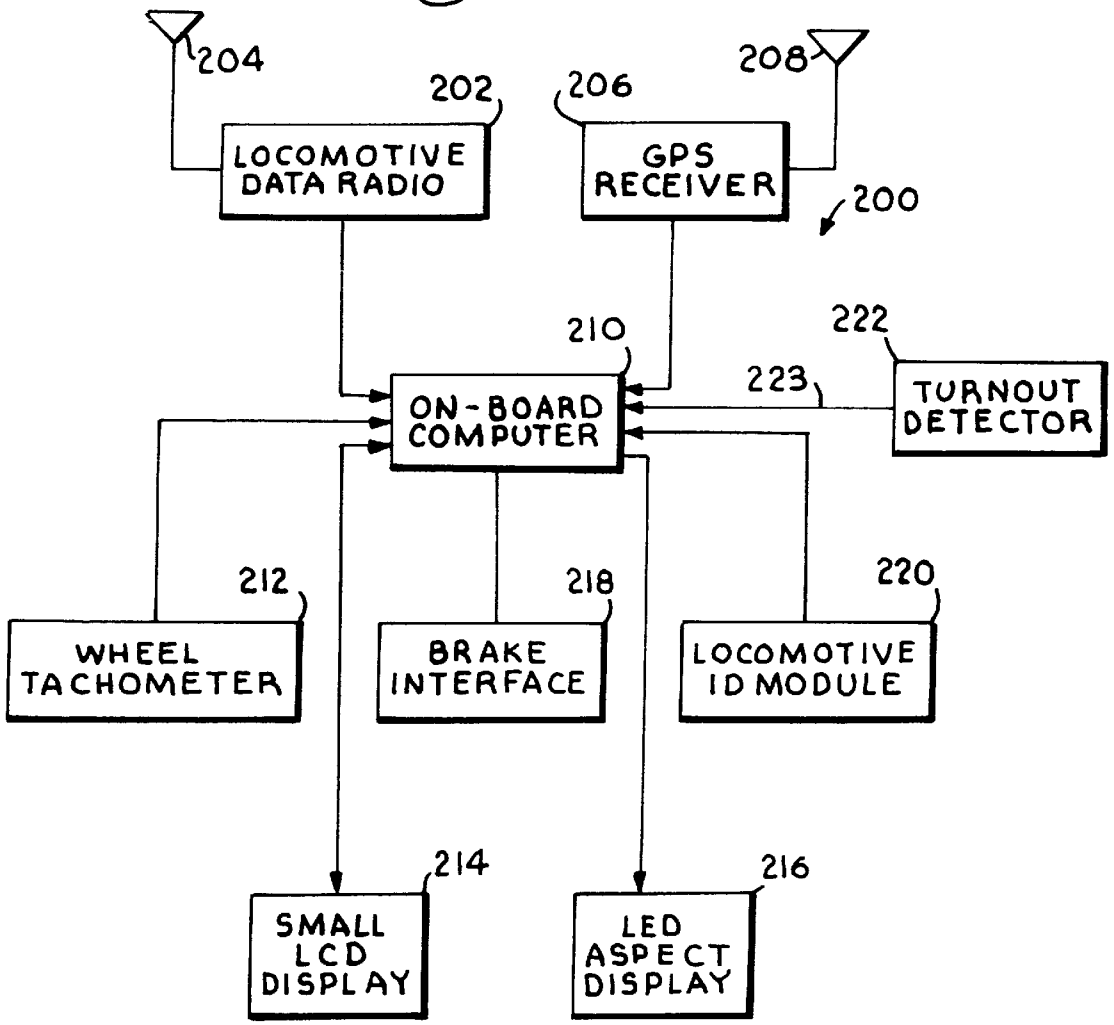
FIG. 2 is a block diagram of the train control system of the present invention.

Now referring to FIG. 2, there is shown an advanced train controlsystem of the present invention generally designated 200 which would be found on board a locomotive (not shown). System 200 includes a locomotive data radio 202 which is coupled to an antenna 204 and further coupled to an onboard computer 210. Also coupled to onboard computer 210 is GPS receiver 206 which is coupled to a GPS antenna 208. Further coupled to onboard computer 210 is wheel tachometer 212, LCD display 214, LED aspect display 216, brake interface 218, and locomotive ID module 220. Radio 202, antennas 204, 208, GPS receiver 206, wheel tachometer 212, displays 214 and 216, brake interface 218, and locomotive ID module 220 are well known in the art. Onboard computer 210 is preferably a computer using a P.C. architecture. The processor and operating system and other details are subject to the desires of the system designer. On-board computer 210 may include a comprehensive rail track database. Coupled to onboard computer 210 via line 223 is turnout detector 222. Turnout detector 222 is described more fully in FIG. 5 and its accompanying text.

Now referring to FIG. 3, there is shown a rail vehicle 300 of the present invention, including a first rail sensor 302 and a second rail sensor 304. Second rail sensor 304 is shown oriented in a direction toward first rail 312, which is disposed beneath first wheel 322. First sensor 302 is shown oriented in a direction toward second rail 314, which is disposed beneath wheel 324.

The rail sensors for this invention are of the general type that emit a signal and receive an echo of that signal reflected from the target. Distance to the target is determined by:

Measuring the time it takes the signal to travel to and from the target.

Dividing the measured time by two since the measured time was for a round trip from the sensor to the target.

Multiplying the one way travel time by the velocity of the signal. For radar or light based rail sensors, the velocity of the signal is the speed of light. For acoustic or ultrasound based distance sensors, the velocity of the signal is the speed of sound.

The preferred embodiment of this invention utilizes a radar to measure the distance to the target. The preferred radar is a very low power, short range device known as a Micropower Impulse Radar as described in U.S. Pat. Nos. 5,361,070; 5,630,216; 5,457,394; 5,510,800; and 5,512,834 issued to Thomas E. McEwan and assigned to The Regents of the University of California. The preferred implementation of the radar operates utilizing very short pulses of Radio Frequency (RF) energy centered at 5.8 GHz. This frequency is preferred to operate the radar because:

This frequency band is currently available for low power devices to operate without a license from the FCC.

The wavelength of a signal in this band, is approximately 5.2 centimeters, which is small compared to the size of the target. (Lower frequency operation would result in wavelengths greater in length than the target size with significantly reduced reflection and resolution.)

The frequency is low enough to not be significantly affected by environmental conditions such as rain and snow.

A radar is preferred over other sensor technologies because it is less susceptible to environmental conditions such as rain, snow, dirt, etc. Acoustic and ultrasonic sensors are also affected to a small degree by temperature, barometric pressure, and humidity. These acoustic and other sensors are well known in the art and are discussed in U.S. Pat. No. 5,603,556 issued to Douglas D. Klink and assigned to Technical Services and Marketing, Inc. Two rail sensors are shown in this invention to improve system reliability since they are part of a train safety system. While it is possible to implement this invention with a single rail sensor, having two sensors provide the following advantages:

The "third rail" coming away from the main rail is detected by the rail sensor on the opposite side of the train before it enters the field of view of the rail sensor directly over the start of the switch providing a quicker responding system. With only one rail sensor, the detection time is dependent on the direction taken through the switch.

Two rail sensors reduce the probability of false alarm. One rail sensor will detect the "third rail" coming towards it, followed by the other rail sensor suddenly detecting the "third rail" much closer than the normal target and moving away from it.

Distance data from the rail sensors can be evaluated in a differential mode to increase reliability and to cancel out any residual environmental effects that are common to both rail sensors.

Two rail sensors provide redundancy for higher overall system reliability.

It is believed that the preferred method of aiming or orienting rail sensors 302 and 304 is to direct the emitted energy from rail sensors 302 and 304 toward the concave sections of the rails 314 and 312 as shown in FIG. 3. The precise aiming technique which is preferred is as follows: a 60° cone of radiant energy is emitted onto the center or bore sight being directed at the center of the inside curved surface of the rail, between the rail head and the rail base for a rail interior to and immediately adjacent to the rail on the opposite side of the locomotive.

Figure 4A:
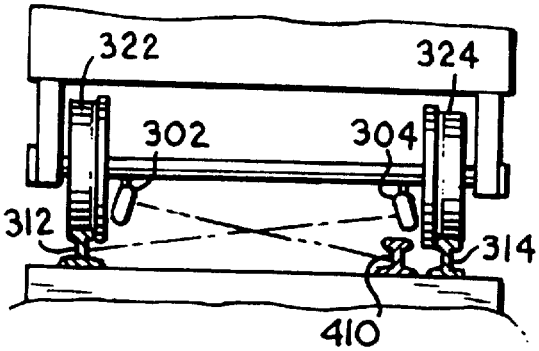
FIG. 4*a* is an elevational view of a rail vehicle of FIG. 3, as it passes over a right turn switch and an intermediate rail is located between the rails over which the rail vehicle travels.

Now referring to FIG. 4*a*, there is shown a rail vehicle 300 of FIG. 3. Also shown in FIG. 4*a* is an intermediate rail 410 disposed adjacent to rail 314. This configuration of the rails, including first rails 312 and 314 and intermediate rail 410, represents the view from the front of a locomotive traveling along track 102 in a direction from point A to point B as the locomotive passes switch 106. The position of intermediate track 410 corresponds to the position of track 110 as it would occur at position AA along track 102 of a locomotive traveling from point A to point B along track 102.

Figure 4B:
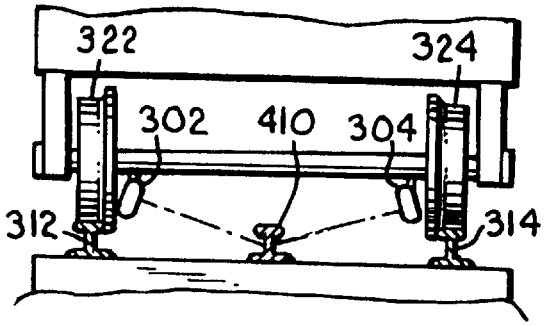
FIG. 4*b* is an elevational view of a rail vehicle of FIG. 3 which shows the position of the intermediate rail which corresponds to an intermediate position through a rail switch.

Now referring to FIG. 4*b*, there is shown a rail vehicle 300 which shows an intermediate rail 410 disposed between rails 314 and 312. Rail 410 would correspond to rail 110 at position AB as a rail vehicle travels from point A to point B along track 102 of FIG. 1.

Figure 4C:
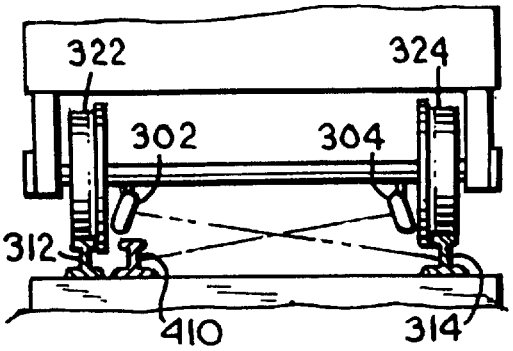
FIG. 4*c* is an elevational view of a rail vehicle of FIG. 3 which shows the intermediate rail at the opposite side, with respect to FIG. 4*a*, which corresponds to a point along the right turn rail switch which is nearing the end of the switch.

Now referring to FIG. 4*c*, there is shown a view of the rail vehicle 300 as it would appear as the vehicle approaches point AC of FIG. 1. Intermediate rail 410 is shown disposed adjacent to rail 312.

In FIGS. 4*a*, 4*b*, and 4*c*, rails 312 and 314 would correspond to track segments 112 and 114 of FIG. 1.

Now referring to FIG. 5, there is shown a simplified block diagram of the turnout detector 222 of the present invention.

Turnout detector 222 may contain a rail sensor 302 or other known distance sensors. Preferably signals output from rail sensor 302 are processed by signal processing circuitry 502, which outputs information on line 223 to on-board computer 210 of FIG. 2. It should be understood that the signal processing function could be performed centrally by computer 210 or at least partially distributed to turnout detector 222.

In one specific embodiment, the rail sensor 302 is a radar type. One type of rail sensor 302 tested is a Micropower Impulse Radar Rangefinder from Lawrence Livermore National Laboratories.

The preferred scan rate of this type of radar for this usage is 38 cycles per second. A sample rate as low as 20 cycles per second may be used.

In a preferred embodiment, the detector 222 has a strong preference for accepting the first return it might receive.

In one embodiment using a radar range finder, an automatic gain control is added to the detector. This is done to compensate for the fact that the amplitudes of the reflections from the rail have considerable variation. This variation can occur due to misalignment between the radar and the rail that can cause the reflection to scatter. A minimum threshold stop was added to a constant fraction discriminator that is used to detect the leading edge of the reflection in the A-Scan output and toggle the pulse to a lower state. The minimum threshold stop eliminates spurious reflection signals and leakage signals. A first reflection capture may be added to keep the radar locked on the rail. Special antennas may be used to reduce leakage and optimize for the specific mounting.

The signal processor in a specific embodiment may comprise a single board 486 computer with a 6 megabyte PCMCIA solid state disk. In another embodiment for use in more economical applications, the signal processor may be an 8 bit computer with sufficient random access memory to store a sample record and sufficient read only memory to store signal processing programs and threshold limits.

In operation, and now referring to FIGS. 1 through 5, a determination of the passage of a locomotive over a switch and the direction of travel through the switch, as well as the angle of the various tracks can be determined as follows: A locomotive 300 travels along track 102 from point A to point B, it passes switch 106, assuming that the locomotive passes straight through switch 106 and proceeds along track 102 to position B. When the locomotive is in position A of FIG. 1, the wheel and rail configurations, as seen from the front of the locomotive looking in a direction toward the rear of the locomotive, would be depicted by FIG. 3 in which there are no intermediate rails between rails 312 and 314. As the locomotive enters switch 106, the rails of track 104 begin to appear. At position AA, the front view would be depicted by FIG. 4*a*. As the locomotive passes by position AB, the view from the front of the locomotive would be shown as in FIG. 4*b*. Similarly, FIG. 4*c* would depict the view from the front looking toward the rear of the locomotive as it passes or approaches point AC.

The sensors 302 and 304 are able to detect the presence of the intermediate rail 410 as its relative position with respect to rails 312 and 314 changes as the locomotive 300 passes through the switch 106. If the speed of the locomotive is known either by wheel tachometer information, GPS or other means, then the rate at which the rail 410 appears to move between rails 312 and 314 will be indicative of the angle of the respective tracks 102 and 104. With high-speed trains, the angle of switching from one track to another is at a slighter angle and, therefore, a different switch is utilized. Given the known speed of the locomotive and the measured rate at which the intermediate rail moves between the rails 312 and 314, onboard computing equipment can determine the angle of the switch and determine the switch type which can be helpful in determining the exact location of the switch being encountered.

Additionally, the direction of relative motion of the intermediate rail will indicate which direction the locomotive proceeds through the switch. For example, if the locomotive traveling on track 102 at position A were to be switched onto track 104 at switch 106 and proceed toward point C, then the intermediate rail would appear at point AA on the opposite side and would appear to move in an opposite direction from that which is described above for a train traveling straight from point A to point B. In the situation where the train is traveling from A to C, the view at point AA would be represented by FIG. 4*c*, which would proceed through FIG. 4*b* at point AB and would result in a view as shown in FIG. 4*a* when the locomotive passes point AC.

In operation, and now referring to the Figures, the turnout detector 222 of the present invention works closely with the on-board computer 210, GPS receiver 206, and a track database which may be included in on-board computer 210 or located at a central location and coupled to the system 200 through locomotive data radio 202. The GPS receiver 206 provides current position information and together with the on-board computer 210 and the track database can predict when a train is approaching a switch or other track feature. These predictions may be used to initiate the turnout detector 222 into a monitoring mode or in an alternative embodiment, turnout detector 222 may be in continuous operation, but the GPS driven track position prediction may be compared to the output of the turnout detector to determine precisely when a switch or other track feature has been passed. In some situations, the on-board computer 210 might be advised of the possibility of passing a track feature which might otherwise be interpreted as a third rail normally associated with a switch. For example, when a train crosses a highway at a grade crossing, pavement or other material is usually disposed between the rails to provide for a safer and smoother crossing of the rails by automobiles. The presence of this material might otherwise "confuse" turnout detector 222. However, when turnout detector 222 works closely with GPS receiver 206 and on-board computer 210 in conjunction with the track database, this information can be used to confirm that the train has crossed a grade crossing. Similarly, the turnout detector 222 may detect the passing of certain railroad bridges, and this information may be also used to precisely confirm the train's position.

It is thought that the method and apparatus of the present invention will be understood from the foregoing description and that it will be understood from the foregoing description that it will be apparent that various changes may be made in the form, construction, steps and arrangement of the parts and steps thereof, without departing from the spirit and scope of the invention or sacrificing all of their material advantages. The form herein described being a preferred or exemplary embodiment thereof.

We claim:

1. An apparatus on board a rail vehicle of the type for traveling over a first rail and a second rail in which said first rail and said second rail are substantially parallel, said apparatus for aiding in train control comprising:

a first detector on board said rail vehicle for detecting the presence of a third rail disposed between said first and said second rails beneath said rail vehicle, said first detector for generating a first detection signal when detecting said third rail, said first detector includes at least one of a short-range radar detector and an optical detector; and a computing device coupled to said first detector for receiving said first detection signals therefrom and analyzing characteristics of said first detection signals.

2. The apparatus, according to claim 1, wherein said apparatus further includes:

a second detector on board said rail vehicle for detecting the presence of said third rail disposed between said first and said second rails beneath said rail vehicle, said second detector for generating a second detection signal when detecting said third rail; and said computing device for receiving said first detection signals from said first detector further for receiving said second detection signals from said second detector and analyzing characteristics of said first and said second detection signals.

3. The apparatus, according to claim 2, wherein said rail vehicle has a first side and an opposing second side with said first detector being disposed on said first side of said rail vehicle and said second detector being disposed on said second side of said rail vehicle.

4. The apparatus, according to claim 3, wherein said characteristics of said first and said second detection signals are indicative of the direction of relative movement of said third rail with respect to said first and said second rails as said rail vehicle travels through a switch used to link one track comprised of said first and said second rails with another track comprised of said third rail and a fourth rail.

5. The apparatus, according to claim 4, wherein said computing device further analyzes said first and said second detection signals to ascertain the relative rate at which said third rail moves with respect to said first and said second rails as said rail vehicle travels through said switch.

6. The apparatus, according to claim 1, wherein said first detector on board said rail vehicle is said short-range radar detector.

7. The apparatus, according to claim 1, wherein said first detector on said rail vehicle is said optical detector.

8. The apparatus, according to claim 1, wherein said first detector on board said rail vehicle includes an acoustic sensor.

9. The apparatus, according to claim 1, wherein said apparatus further includes a GPS receiver and a data radio.

10. An apparatus for use in controlling a rail vehicle of the type traveling upon a first rail and a second rail; said apparatus comprising:

means for measuring a distance from a first predetermined position on said rail vehicle to a third rail disposed between said first and said second rails and for generating a first distance signal therefrom, said means for measuring includes at least one of a low-power short-range radar device and an optical detector; and means for monitoring said first distance signal to determine if changes occur in said distance over time as said rail vehicle travels along said first and said second rails.

11. The apparatus, according to claim 10, wherein said means for measuring said distance from said first predetermined position on said rail vehicle to said third rail is said low-power short-range radar device.

12. The apparatus, according to claim 10, wherein said means for monitoring said first distance signal is a multipurpose computer on board said rail vehicle.

13. The apparatus, according to claim 10, wherein said means for monitoring said first distance signal is a microprocessor dedicated to use in association with said means for measuring said distance from said first predetermined position on said rail vehicle to said third rail.

14. The apparatus, according to claim 10, wherein said means for monitoring said first distance signal includes a data radio and a computer processor disposed remotely from said rail vehicle.

15. The apparatus, according to claim 10, wherein said apparatus further includes a second means for measuring a distance from a second predetermined position on said rail vehicle to said third rail disposed between said first and said second rails and for generating a second distance signal therefrom.

16. The apparatus, according to claim 15, wherein said apparatus further includes a GPS receiver, coupled to said means for monitoring said distance signals, for providing position information of said rail vehicle as said rail vehicle progresses along said first and said second rails.

17. The apparatus, according to claim 16, wherein said apparatus further includes a data radio, coupled with said means for monitoring said distance signals, for generating a signal to a remote location containing information relating to positional information of said rail vehicle.

18. A method of controlling a rail vehicle of the type which travels on a first rail and a second rail, said method comprising the steps of:

transmitting an outgoing signal from at least one of a short-range radar detector and an optical detector attached to a predetermined position on said rail vehicle to a third rail disposed between said first and said second rails;

receiving a return signal reflected by said third rail and determining a time interval between when said outgoing signal was transmitted and said return signal is received;

determining a distance from said predetermined position on said rail vehicle to said third rail disposed between said first and said second rails by utilizing said time interval; and affecting the operation of said rail vehicle in response to said distance so determined.

19. The method, according to claim 18, wherein said step of transmitting includes using a low-power type of said short-range radar detector to generate and transmit said outgoing signal.

20. The method, according to claim 18, wherein said steps of transmitting, receiving and determining are repeated during a predetermined time interval.

* * * * *